US006637938B2

(12) United States Patent
Watkins

(10) Patent No.: US 6,637,938 B2
(45) Date of Patent: Oct. 28, 2003

(54) LAUNDRY APPARATUS

(76) Inventor: Deborah H. Watkins, 5005 Robinwood Rd., Durham, NC (US) 27713

( * ) Notice: Subject to any disclaimer, the term of this patent is extended or adjusted under 35 U.S.C. 154(b) by 0 days.

(21) Appl. No.: 10/010,208

(22) Filed: Dec. 6, 2001

(65) Prior Publication Data

US 2003/0108254 A1 Jun. 12, 2003

(51) Int. Cl.[7] ..... B65D 33/14

(52) U.S. Cl. ..... 383/23; 383/33; 383/40; 248/99

(58) Field of Search ..... 383/22, 23, 33, 383/40; 248/99, 101

(56) References Cited

U.S. PATENT DOCUMENTS

| | | | | | |
|---|---|---|---|---|---|
| 1,657,790 | A | * | 1/1928 | Colliton | 383/23 |
| 1,809,317 | A | * | 6/1931 | Snyder | 248/292.14 |
| 3,814,359 | A | * | 6/1974 | Powell | 248/99 |
| 3,841,592 | A | * | 10/1974 | Witten | 248/101 |
| 4,497,463 | A | * | 2/1985 | Wendel | 248/95 |
| 4,926,060 | A | | 5/1990 | Sittig | |
| 4,940,232 | A | | 7/1990 | Chen | |
| 5,098,108 | A | | 3/1992 | McKinney | |
| 5,356,001 | A | * | 10/1994 | Luna | 206/315.1 |
| 5,405,043 | A | | 4/1995 | Meloney | |
| 5,762,569 | A | | 6/1998 | Hale | |
| 5,836,553 | A | * | 11/1998 | Bergaila | 248/99 |

OTHER PUBLICATIONS

Copy of telefaxed advertisement for Hanging Hamper, obtained Nov. 2001.

* cited by examiner

*Primary Examiner*—Jes F. Pascua
(74) *Attorney, Agent, or Firm*—Lynn E. Barber

(57) ABSTRACT

A laundry apparatus that is mountable on a door, including a mountable rim and a laundry bag that may be attached to the rim or removed from the rim. The rim is held in a generally horizontal position in which the laundry bag is open, but may be lowered to take up less space. The rim of the laundry bag is mountable on a surface, such as a vertical surface of a door, using a mounting plate to which the rim is attached. The mounting plate is either affixed directly to the surface or suspended from above the surface, such as with an over-the-door bracket.

12 Claims, 5 Drawing Sheets

LAUNDRY APPARATUS

BACKGROUND OF THE INVENTION

1. Field of the Invention

This invention relates to containers for laundry, such as laundry bags.

2. Description of the Related Art

There are many different types of containers for dirty laundry, including sturdy-sided hampers, laundry baskets, and laundry bags. Typically, hampers are designed as furniture and hide the laundry inside the hamper, and therefore hampers may be placed in a bedroom or bathroom or other room, and do not need to be placed in a closet. When it is time to wash the laundry, however, a hamper is generally too bulky to carry, and must be opened and the laundry carried to the wash machine in another container, such as a laundry bag or basket. Advantages of laundry bags include that they can be made to fit into differently-sized spaces, may be closed, and may be washed with the laundry. Laundry bags and baskets are typically placed in a closet because they usually present a sloppy appearance. Another problem with laundry bags, particularly when used by children or other people who are not highly motivated to put away their dirty clothes, is that opening of the laundry bag that is lying on the floor is difficult and it takes time to get the laundry in the opening and be sure the laundry is completely placed in the laundry bag.

Although a laundry bag hung from a vertical rim is known in the art (Pro-Mart Industries, Inc., Rancho Cucamonga, Calif.), prior hung laundry bags known to the inventor herein are not movable between a vertical and horizontal position of the rim and do not have the alternative capabilities of being hung from a door and being mountable on the face of a door.

It is therefore an object of the invention to provide a laundry apparatus that is mountable on a door or other vertical surface, and which holds a laundry bag open for easy addition of laundry or may be folded down to be out of the way. It is a further object of the invention to provide a laundry apparatus in which the laundry bag is removable from the apparatus, closable and washable.

Other objects and advantages will be more fully apparent from the following disclosure and appended claims.

SUMMARY OF THE INVENTION

The invention herein is a laundry apparatus that is mountable on a door. It includes a mountable rim and a laundry bag that may be attached to the rim or removed from the rim. The rim is held in a generally horizontal position in which the laundry bag is open, but may be lowered to take up less space. The rim of the laundry bag is preferably mountable on a surface, such as a vertical surface of a door, using a mounting plate to which the rim is attached. The mounting plate is either affixed directly to the surface or suspended from above the surface, such as with an over-the-door bracket Other objects and features of the inventions will be more fully apparent from the following disclosure and appended claims.

DETAILED DESCRIPTION OF THE INVENTION AND PREFERRED EMBODIMENTS THEREOF

Figure 1:
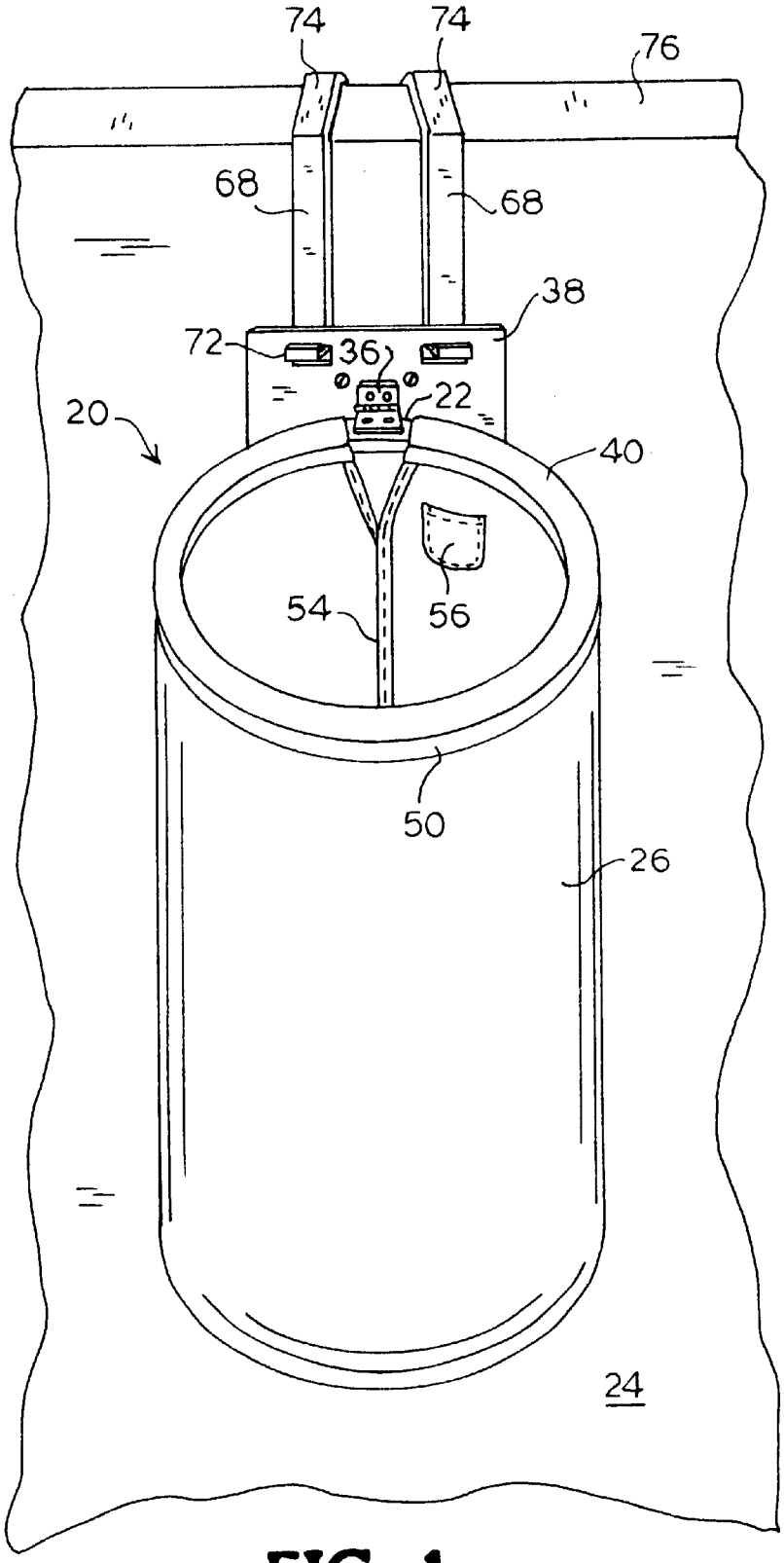
FIG. 1 is a front perspective view of the laundry apparatus of the invention mounted on a door.
Figure 2:
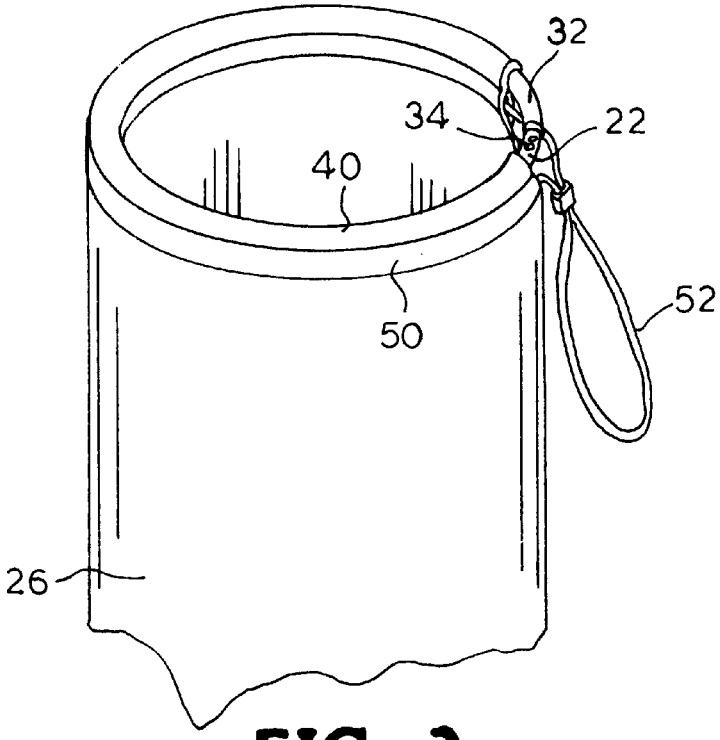
FIG. 2 is a side perspective view of the rim piece and laundry bag of the invention.

The present invention is a laundry apparatus, comprising a rim that is mountable on a surface and a laundry bag that may be attached to the rim or removed from the rim. The mounted laundry apparatus is adjustable between a generally horizontal position of the rim in which the laundry bag is open, and a lowered position in which the rim folds down toward the vertical surface and the laundry bag opening is in a generally vertical position. The laundry bag may have a pocket on it for holding an air freshener. The rim of the laundry bag is preferably mountable on a surface, such as a vertical surface of a door, using a mounting plate to which the rim is attached. The mounting plate is either affixed directly to the surface or suspended from above the surface, such as with an over-the-door bracket.

Referring in greater detail to the Figures, as shown in FIGS. 1–2, and 6–7, the laundry apparatus 20 of the invention comprises a rim piece 22 that is mountable on a surface 24, preferably a generally vertical surface, and a laundry bag 26 that is attachable to the rim piece 22 as discussed below. The rim piece 22 is a generally circular piece, similar to the rim of a basketball hoop, and made of metal or a sturdy, durable plastic, except that it is not a continuous piece but rather is an incomplete circle, having a first end 28 and a second end 30.

Figure 6:
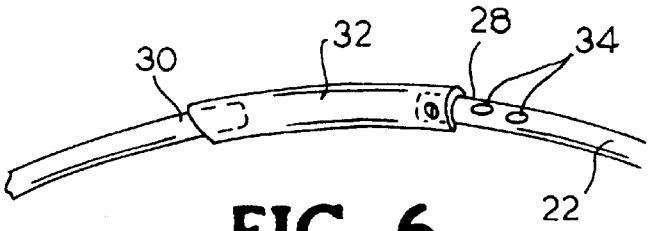
FIG. 6 is a perspective view of a closed rim of the invention.
Figure 7:
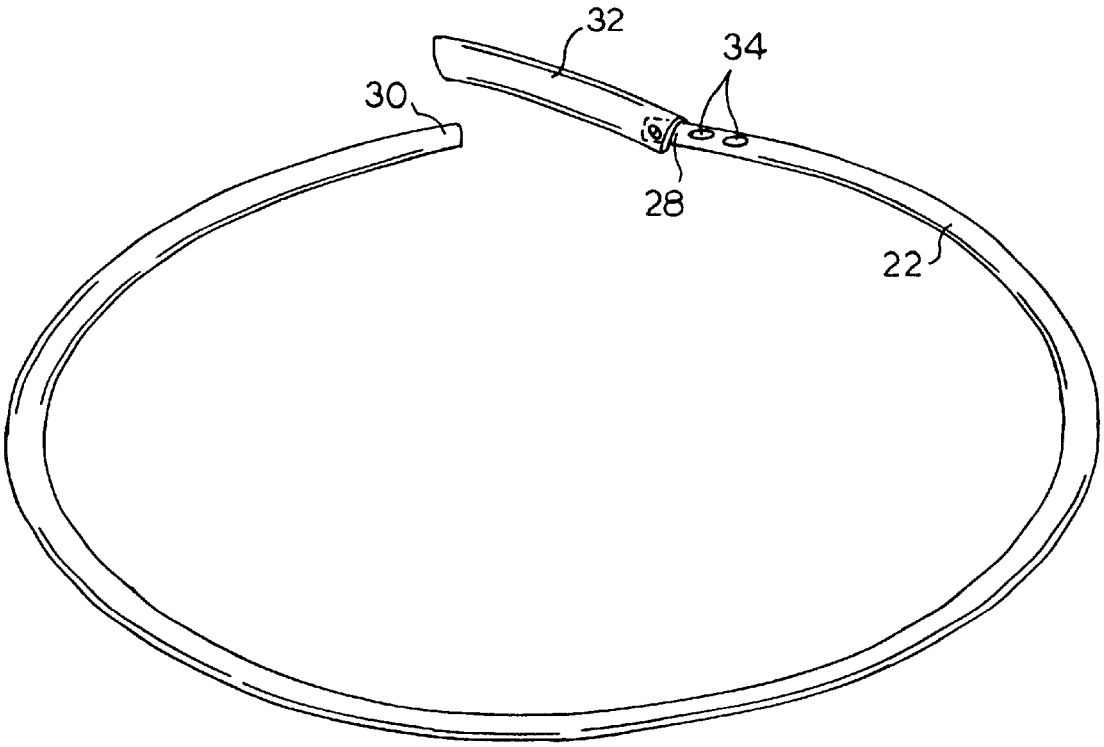
FIG. 7 is a perspective view of an open rim of the invention.

As shown in FIGS. 6–7, preferably the ends 28,30 are separable from each other and attachable together as is known in the art for attaching the ends of two tubular rods or other ends to form an integral piece. Thus, examples of attachment fixtures 32 for closing the rim piece ends 28,30 together include a pivoting clasp similar to what might be used in a necklace or bracelet, or any other type of closure known in the art that may be opened to allow the laundry bag 26 to be placed over or removed from the rim piece 22, and then closed sufficiently so that the laundry bag 26 does not fall off of the rim piece 22. In some instances, if the rim piece 22 can be fabricated sufficiently sturdily and/or the laundry bag 26 and rim piece 22 are made of materials so that the laundry bag does not easily slip off of the rim piece when the opening is not closed, and/or the rim piece 22 has an opening sized to attach and remove the laundry bag but sufficiently small so that the laundry bag does not easily slip off of the rim piece when the opening is not closed, a closure is not necessary.

The first end 28 is affixable to the surface 24 as discussed below. If there is an attachment fixture and if a portion of the attachment fixture 32 is particularly large, it is important that this large portion is on the first end 28 of the rim piece 22 and not on the second end 30, so that the size of this portion does not inhibit placement of the laundry bag 26 on the rim piece 22 over the second end 30 as described below.

Towards the first end 28 of the rim piece 22 are two screw holes 34 (FIGS. 6–7) for mounting the rim piece 22, with screws 35, to a first end 46 of hinge 36 which is attached to a mounting plate 38 (FIG. 3) on second end 48 of hinge 36 as discussed further below. The second end 30 of the rim piece 22 is thus hanging free and unattached to the mounting plate 38 when the attachment fixture 32 is open. Opening the rim piece 22 by opening the attachment fixture 32 allows the laundry bag 26 to be slipped on to and removed from the second end 30 of the rim piece 22 as is desired. To enable this, the laundry bag 26 thus has an upper casing 40 through the entirety of which the second end 30 of the open rim piece 22 may be threaded so that the laundry bag 26 hangs from the rim piece 22 with the two ends 28,30 of the rim piece 22 protruding out of the upper casing 40. The two ends 28,30 of the rim piece 22 may then be attached together using the attachment fixture 32 to keep the laundry bag 26 from inadvertently sliding over the second end 30 of the rim piece 22 and falling to the floor. When the rim piece 22 is mounted on a vertical surface by screws 42 through screw holes 44 in the second end 48 of hinge 36 which is mounted on the mounting plate 38, it is clear that the laundry bag 26 cannot slip over the first end 28 of the rim piece 22.

Figure 5:
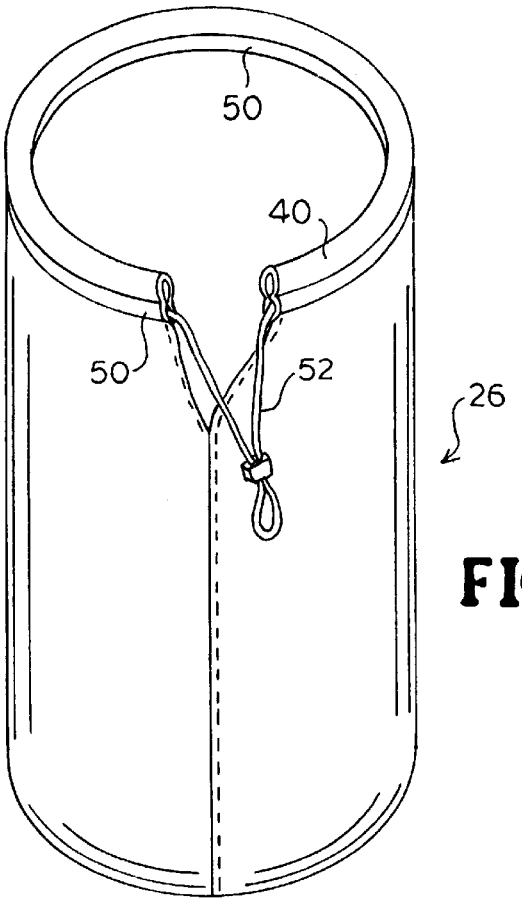
FIG. 5 is a back perspective view of a laundry bag used on the apparatus of the invention.

A second casing 50 at the top of the laundry bag 26, preferably below the upper casing 40, is for insertion of a drawstring 52 for closing the laundry bag 26 when it is removed from the rim piece 22. Both the upper casing 40 and second casing 50 are preferably open at their ends at the top of the same side of the laundry bag 26. Laundry bag 26 preferably has a seam 54 below the casing ends for ease of attachment of the laundry bag 26 to the rim piece 22 and for insertion and tying of the drawstring 52 (FIG. 5).

The laundry bag 26 used in the invention may be any standard fabric laundry bag modified to enable it to be placed on the rim. Thus, laundry bag 26 could be a mesh bag or could be a standard fabric bag, for example, if it is desirable that the contents of the bag not be visible, or any other type of laundry bag. The laundry bag 26 also has an optional pocket 56 as shown in FIG. 1 for insertion of an air freshener (not shown).

Figure 3:
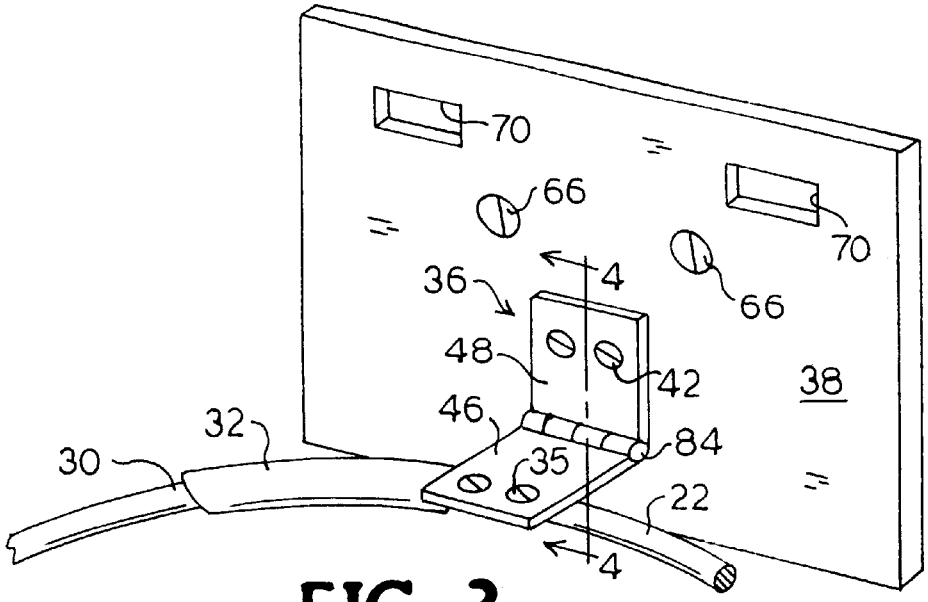
FIG. 3 is a partial upper perspective view of the mounting plate and hinge of the invention with the rim piece mounted on the mounting plate (laundry bag not shown).
Figure 4A:
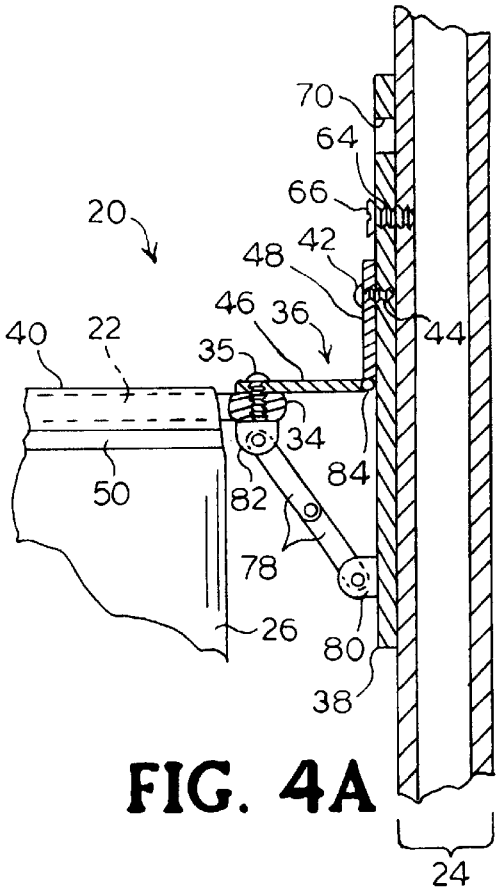
FIG. 4A is a side partial cross-sectional view of the mounting plate, hinge and bracket of the invention with the rim piece mounted on the mounting plate.
Figure 4B:
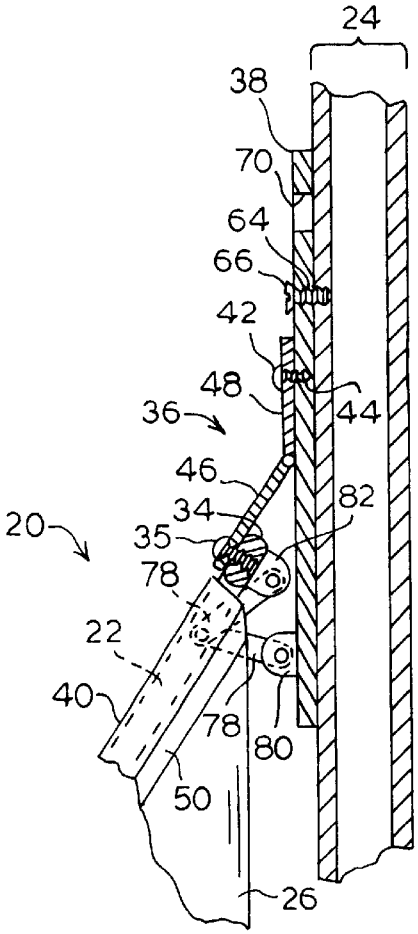
FIG. 4B is a side perspective view of the laundry apparatus of the invention, showing the laundry apparatus in the folded position.
Figure 8:
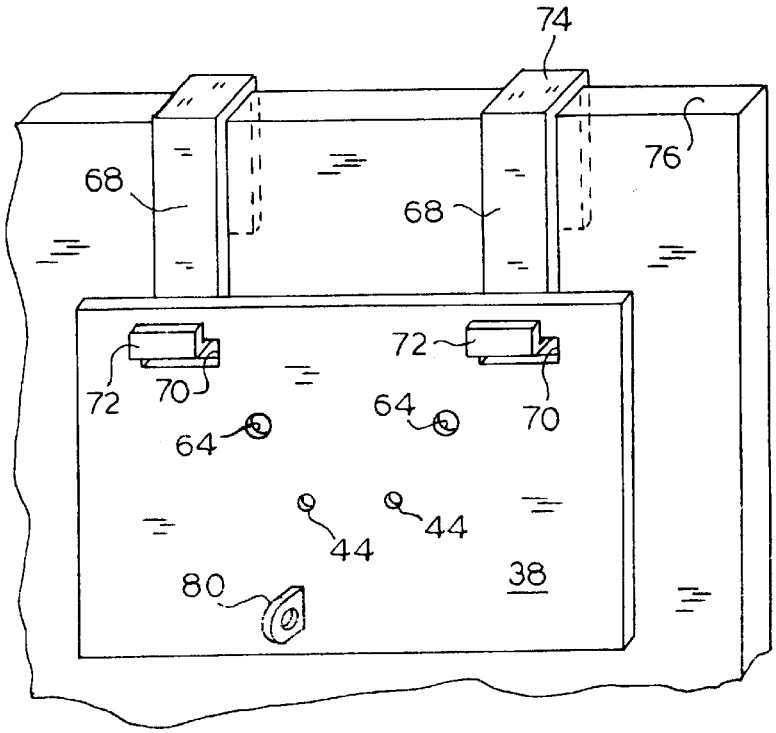
FIG. 8 is a front perspective view of a mounting plate mounted on a bracket hung over a door.

As mentioned above, the primary preferred means of attachment of the rim piece 22 to a surface 24, such as a door or other vertical surface, comprises a mounting plate 38 (FIGS. 3 and 8). As shown in FIGS. 4A–4B, screws 35 may be placed through screw holes 44 in a first end 46 of hinge 36 and through the rim screw holes 34 to hold the first end 46 of the hinge 36 to the rim piece 22. The second end 48 of hinge 36 also has two screw holes 44 as known in the art for attachment of the hinge 36 to the mounting plate 38. An additional two screw holes 64 are provided in the mounting plate 38 so that the mounting plate 38 may be attached to the vertical surface, preferably a door, by additional screws 66.

If the owner of the laundry apparatus of the invention does not wish to put holes in the door for the mounting plate 38, two over-the-door brackets 68 may be used (FIGS. 1 and 8). The mounting plate 38 is provided with two bracket holes 70, which allows the mounting plate 38 to be hung over the lower ends 72 of the brackets 68, and the other end 74 of each of the brackets 68 may be hung over the top 76 of the door without necessitating direct attachment of the mounting plate 38 to the surface of the door.

To make mounting of the rim piece 22 to the mounting plate 38 more secure, a number of improved variations of the invention are possible. A second hinge (not shown) may be used in the same manner as the first hinge 36 at an adjacent location to the first hinge 36 to hold the rim piece 22 to the mounting plate 38. More preferably, one or more lockable hinged braces 78 as shown in FIGS. 4A–4B may be used below the hinge(s). In this embodiment, the mounting plate 38 has a protruding flange 80 and there is a corresponding rim protrusion 82 on the rim piece 22 for each lockable hinged brace 78, for attachment of the lockable hinged brace 78 to both the mounting plate 38 and the rim piece 22. When the rim piece 22 is lowered as shown in FIG. 4B, the hinge(s) 36 bend around the central hinge pivot pin 84 and the lockable hinged brace(s) 78 unlock to allow the rim piece 22 downward movement.

Other types of brackets, hinges and/or braces or other structures may be used, which are sufficiently sturdy to hold the rim piece 22 to the door or wall and can be collapsed to allow the rim piece 22 to hang generally vertically as described and shown above. For example, there are a number of different folding table brackets, bench brackets, hinged spring brackets which may be used such as those as shown in the catalog of Hafele (a German company, with U.S. offices located in Archdale, N.C.).

Although the laundry apparatus 20 of the invention is preferable structured as described above, the shape of the rim piece 22 may be other than circular, for example, oval, square, rectangular, etc., so long as the shape does not prevent attachment of the laundry bag 26. Other variations could also include other means of attaching the laundry apparatus to a door or wall, as are known in the art.

While the invention has been described with reference to specific embodiments, it will be appreciated that numerous variations, modifications, and embodiments are possible, and accordingly, all such variations, modifications, and embodiments are to be regarded as being within the spirit and scope of the invention.

What is claimed is:

1. A laundry apparatus comprising:

a) a rim piece mountable on a surface; and b) a laundry bag that may be attached to the rim piece or removed from the rim piece; wherein the rim piece of the laundry apparatus is adjustable between a generally horizontal position in which the laundry bag is open, and a lowered position in which the rim piece folds down toward the surface, utilizing a collapsible structure that is attached to the rim piece and to the surface, said structure being collapsible downward, while attached to the surface, to lower the attached rim piece; and wherein the rim piece is in the form of an incomplete circle that has two ends that are attachable to each other to form an openable closure, so that the rim piece may be closed or may be opened for attaching or removal of the laundry bag.

2. The laundry apparatus according to claim 1, further comprising a pouch on the laundry bag for holding an air freshener.

3. The laundry apparatus according to claim 1, wherein the collapsible structure comprises a hinge.

4. The laundry apparatus according to claim 1, wherein the collapsible structure comprises a lockable hinged brace.

5. The laundry apparatus according to claim 1, wherein the collapsible structure a hinge and a lockable hinged brace.

6. The laundry apparatus according to claim 1, wherein the rim piece is mountable on the surface using a mounting plate to which the rim piece is attached using the collapsible structure.

7. The laundry apparatus according to clam 6, wherein the collapsible structure comprises a hinge.

8. The laundry apparatus according to claim 6, wherein the collapsible structure comprises a lockable hinged brace.

9. The laundry apparatus according to claim 6, wherein the the collapsible structure comprises a hinge and a lockable hinged brace.

10. The laundry apparatus according to claim 6, wherein the mounting plate is affixed to a vertical surface.

11. The laundry apparatus according to claim 10, wherein the mounting plate is affixed to a vertical surface using screws.

12. The laundry apparatus according to claim 6, wherein the rim piece is mountable on the surface using an over-the-door bracket which is attached to the mounting plate.

* * * * *